United States Patent [19]

Sedig et al.

[11] Patent Number: 4,589,721

[45] Date of Patent: May 20, 1986

[54] ELECTRICAL CONNECTOR HAVING PIN CONTACT RECEPTACLE WITH RELEASABLE RETAINING MEANS

[75] Inventors: Albert R. Sedig; Fred A. Boccelli, both of Maricopa, Ariz.

[73] Assignee: ITT Corporation, New York, N.Y.

[21] Appl. No.: 624,493

[22] Filed: Jun. 25, 1984

[51] Int. Cl.[4] ..... H01R 4/24

[52] U.S. Cl. ..... 339/210 R; 339/217 S

[58] Field of Search ..... 339/217 S, 210 R, 210 M

[56] References Cited

U.S. PATENT DOCUMENTS

| | | | |
|---|---|---|---|
| 3,697,934 | 10/1972 | Merry | 339/217 S |
| 3,990,768 | 11/1976 | Faber | 339/210 R |
| 4,252,399 | 2/1981 | Bauerle | 339/217 S |
| 4,397,517 | 8/1983 | Shaffer | 339/217 S |

FOREIGN PATENT DOCUMENTS

| | | | |
|---|---|---|---|
| 900218 | 7/1962 | United Kingdom | 339/217 S |

*Primary Examiner*—Gil Weidenfeld
*Assistant Examiner*—Gary F. Paumen
*Attorney, Agent, or Firm*—T. L. Peterson; R. C. Turner

[57] ABSTRACT

A pin contact receptacle stamped and formed from blank stock is provided with retention fingers, each having a hook on the end that engages fore and aft shoulders of an annular ring in the cavity of an insulator, and each having a bend in the middle. A tubular tool can be inserted from the rear over the bends of the retention fingers to collapse them into the receptacle for extracting or inserting the receptacle into the cavity of the insulator.

12 Claims, 7 Drawing Figures

ELECTRICAL CONNECTOR HAVING PIN CONTACT RECEPTACLE WITH RELEASABLE RETAINING MEANS

BACKGROUND OF THE INVENTION

This invention relates to an electrical connector, and more particularly to a molded insulator having one or more cavities, each cavity being shaped to receive a pin contact receptacle having at least two equally spaced retaining fingers that are releasable from the rear end.

Stamped and cold formed pin contact receptacles have been used in numerous configurations in the electrical connector industry. Many have positive retaining means, such as a flexible portion of the insulator, or a flexible portion of the contact inserted into an insulator cavity, such as barbs, hooks, and fingers. The contact receptacle is usually inserted into a cavity of an insulator from the rear with an electrical lead already crimped and/or soldered to the pin contact receptacle. The contact pin is then inserted into the receptacle from the front of the insulator.

Because of the electrical lead preconnected to the pin contact receptacle, the insulator is generally formed to receive the receptacle from the rear. Retaining fingers may be provided on the receptacle that expand radially to engage a shoulder in the insulator cavity. Where the receptacle protrudes through the front of the insulator sufficiently for the fingers to also be exposed, as shown in U.S. Pat. No. 3,957,337, it is not a problem to compress the fingers in order to release the receptacle when it is necessary to remove it. Other arrangements which do not have the retention fingers protruding from the front are so configured that they may be released from the front, for example as shown in U.S. Pat. No. 4,006,961.

In many applications, it is preferable that the pin contact receptacle be releasable from the rear. That is a problem with some connectors, such as the connector shown in U.S. Pat. No. 3,697,934 in which compressible pin contact arms are formed with hooked ends to also serve as retaining fingers that so engage an annular flange that the receptacle cannot be pushed back out of the insulator by the contact pin, or pulled out from the rear by the connected electrical lead. The problem is that such an arrangement is not releasable from the rear, only the front, and before a tubular tool can be used, such as the extraction tool shown in U.S. Pat. No. 3,110,093, to force the hooked arms inwardly toward the axis of the receptacle, it is necessary to push the receptacle forward sufficiently to disengage the hooked ends of the fingers from the annular flange in the insulator cavity.

Note that a contact pin retained in an insulator is illustrated in the U.S. Pat. No. 3,110,093 on the tubular tool, but it could just as well have been a pin contact receptacle. In either case, the contact member is of a type which employs a separate retaining clip trapped within the insulator assembly. It would be desirable to provide a contact receptacle that has an integral retaining means formed as a unitary part of the receptacle and releasable from the rear. This is important for a "closed entry" insulator, which is an insulator having a shaped cavity to receive the receptacle from the rear, and an orifice at the front of the cavity that is just sufficient to receive a contact pin.

SUMMARY OF THE INVENTION

In accordance with an exemplary embodiment of the invention, a pin contact receptacle is provided with unitary retention fingers cut out of the receptacle wall and extending in the direction of its pin receiving end at a small angle with respect to the receptacle axis away from the receptacle wall. The ends of the fingers are bent outwardly and back through to a position approximately parallel with the receptacle axis, thereby to form hooks the rearwardly facing ends of which engage an annular shoulder in the insulator cavity. That annular shoulder is preferably the rear part of an annular groove the dimension of which is just sufficient to receive the hooks at the ends of the retention fingers. This annular groove will thus form a stop shoulder fore and aft of the retainer hooks. In that manner the axial position of the pin contact receptacle can be controlled within the cavity of the insulator.

Each retention finger is formed with an outwardly protruding bend so that when an extraction tool is forced over these bends, the hooked ends of the fingers are forced in toward the axis of the receptacle and into the hollow body of the receptacle, thus facilitating insertion and allowing extraction of the receptacle from the rear.

The diameter of the cavity aft of the annular groove is sufficiently large to allow the extraction tool to be inserted close around the pin contact receptacle in order to force the retention fingers in when inserting or removing the receptacle. Forward of the annular groove, the dimension is less, but sufficient to allow the pin contact fingers to expand upon receiving a contact pin.

Forward of the retention fingers are two end slots cut out of the receptacle, leaving two pin contact fingers which are outwardly flared at the ends and so bent toward each other that they are virtually tangent where the flare begins on each. The flared ends form an elliptical opening to receive a contact pin through an orifice in the insulator of a diameter just sufficient to receive a contact pin.

The novel features of the invention are set forth with particularity in the appended claims. The invention will best be understood from the following description when read in connection with the accompanying drawings.

DESCRIPTION OF PREFERRED EMBODIMENTS

Figure 1:
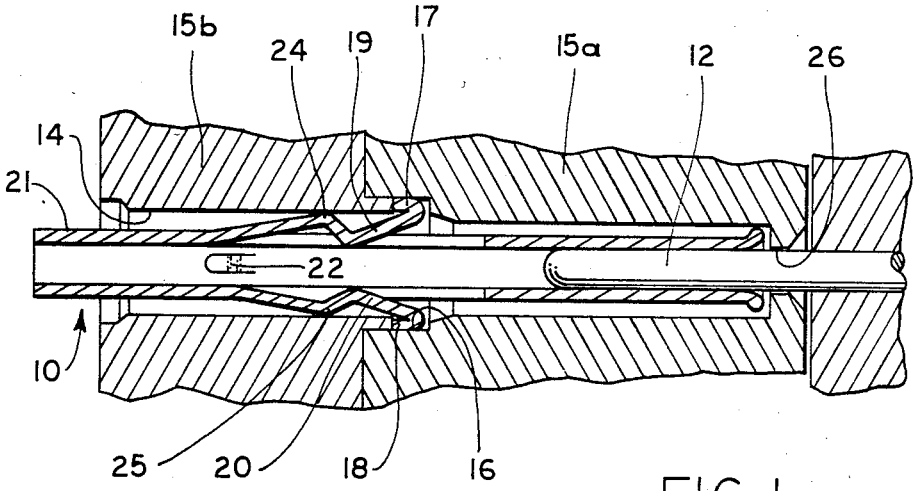
FIG. 1 is a longitudinal sectional view taken on the axis of a tubular pin contact receptacle inserted into a cavity through the rear of an insulator with a contact pin partially inserted into the contact receptacle through an orifice at the "closed end" of the cavity in front of the insulator.

Referring to FIG. 1, a receptacle 10 for a contact pin 12 is shown with the pin inserted therein. The receptacle 10 has been inserted into a cavity 14 in an insulator molded in at least two parts 15*a* and 15*b* for convenience. The two parts are then bonded together before the receptacle is inserted from the rear (which is the left end of the cavity 14, as viewed in FIG. 1).

The cavity is formed with an annular recess 16 that receives hooked ends 17 and 18 of retention fingers 19 and 20. An electrical conductor, not shown, is first inserted into the rear end 21 to a stop tab 22 and then crimped and/or soldered in place.

The hooked ends 17 and 18 serve as retaining means. They are formed on the ends of the fingers 19 and 20 which are in turn formed from sections of the tubular pin contact receptacle with outwardly protruding bends 24 and 25. To release the retention finger hooks 17 and 18 from the receptacle recess 16 in the insulator cavity, an annular tool is inserted from the rear between the end 21 of the pin contact receptacle 20 and the insulator cavity 14. Once the tool has been inserted far enough to fit tightly over the bends 24 and 25, the hooked ends 17 and 18 will be collapsed into the hollow body of the receptacle 10 so that it may be withdrawn with the tool from the cavity. In that manner, a cavity with a closed end in front where it receives the contact pin 12 can be removed for replacement or repair from the rear. The term "closed end" means that the front of the insulator 15*a* is closed except for an orifice 26 which receives the pin 12. That orifice is of a diameter just sufficient for the pin to enter, and not large enough to allow the receptacle to ever protrude out the front. Note that the orifice 26 has a frusto-conical section to facilitate inserting the pin.

Figure 2:
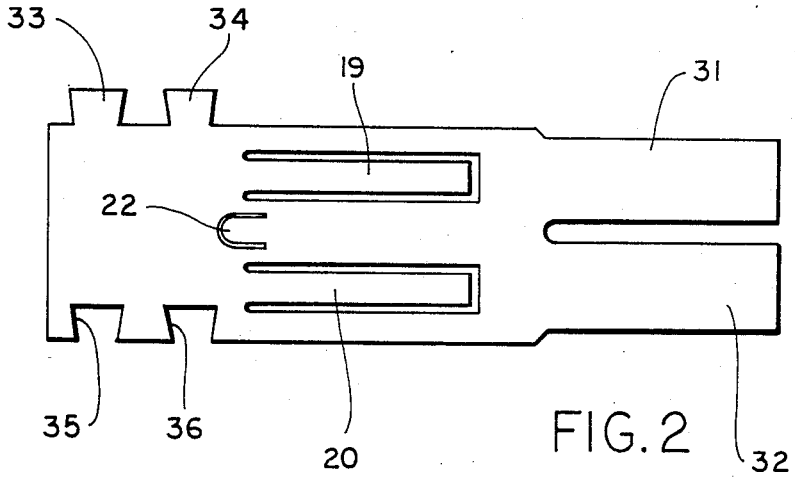
FIG. 2 is a plan view of a blank from which the tubular contact receptacle of FIG. 1 is formed.
Figure 3A:
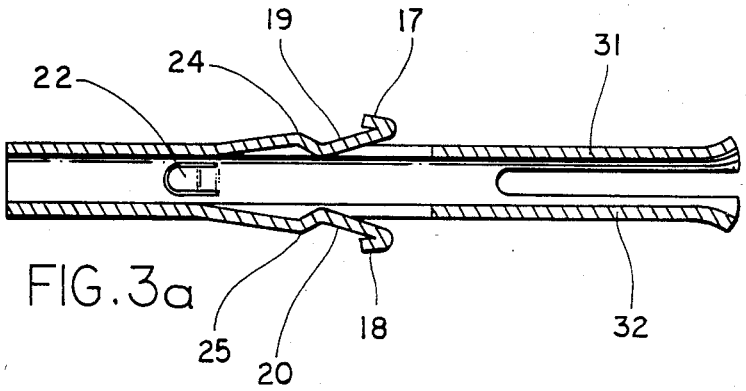
FIG. 3*a* is a longitudinal cross section of the tubular contact receptacle after it has been formed, but before its pin contact fingers are fully formed.
Figure 3B:
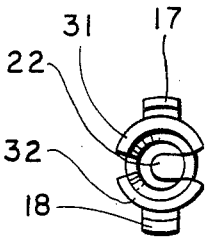
FIG. 3*b* is an end view of the pin contact fingers of the receptacle shown in FIG. 3*a*.
Figure 4A:
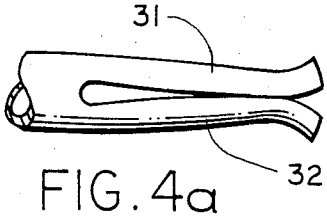
FIG. 4*a* is a view in elevation of the pin contact fingers of the receptacle of FIG. 3 after forming.
Figure 4B:
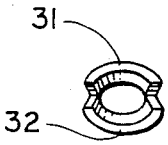
FIG. 4*b* is an end view of the contact fingers shown in FIG. 4*a* after forming.

The receptacle 10 is formed from a blank shown in FIG. 2. Such a blank is made by a simple stamping operation from sheet metal. Before it is formed into a tubular receptacle shown in longitudinal cross section in FIG. 3*a*, the retention fingers 19 and 20 are formed with the bends 24 and 25, and with the hooks 16 and 17, as shown in FIG. 3*a*. Pin contact fingers 31 and 32 are flared at their end in the same direction as the hooks in retention fingers 19 and 20, i.e., away from what will be the axis of the receptacle, and the stop tab 22 is bent in the opposite direction. After the blank is roll formed on a mandrel, the stop tab 21 is bent inwardly. Key tabs 33 and 34 fit into key slots 35 and 36 to hold the receptacle in its rolled form. Following that the pin contact fingers are formed by bending them from their cylindrical position shown in FIG. 3*a* and in the end view in FIG. 3*b*, until they come in contact with each other, as shown in FIGS. 4*a* and 4*b*. After thus bending the pin contact fingers, stress is relieved in them by heating for about one hour at 300° C. (570° F.), after plating where plating is required, such as gold plating.

Figure 5:
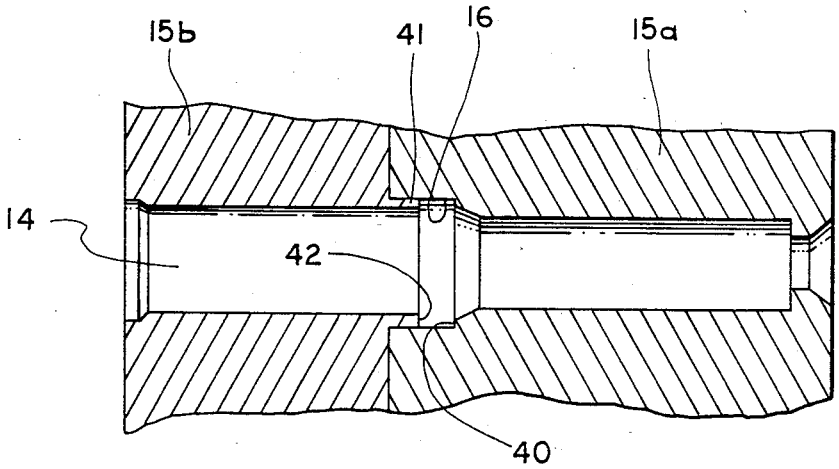
FIG. 5 is a longitudinal cross section of the insulator for the contact receptacle shown in FIG. 1.

The insulator for the connector can be best seen in FIG. 5. Note that the recess 16 that is to receive the hooks of the retention fingers of the receptacle has its forward shoulder 40 formed in the first part 15*a*, and that an annular protrusion 41 of the second part 15*b* fits into the bore of the first part to form the rear shoulder 42 of the annular recess. These shoulders serve as stops fore and aft for the retainer hooks, so that axial position of the contact can be positively controlled within the cavity, as shown in FIG. 1.

It is important to have the forward shoulder of the recess arranged to position the pin contact receptacle with the front end of its pin contact fingers spaced away from the closed entry of the insulator. Otherwise, the inside of the "closed entry" may come in contact with the fingers and prevent them from flexing. This flexing is important in order to assure a good electrical contact between the pin and the contact fingers, as shown in FIG. 1. As a further precaution, sharp edges on the flared ends of the contact fingers are removed before inserting the receptacle into the insulator cavity.

A tool of the type disclosed in U.S. Pat. No. 3,110,093 is preferably used not only to remove the receptacle, but also to insert it. Otherwise forcing the receptacle in with the hooks scraping against the wall of the bore in the rear part may tend to cause the hooks to become bent too much, in which case the hooks might then not fit squarely against the aft shoulder provided by the recess. As a consequence, retention of the receptacle in the cavity may not be as certain as it otherwise would be.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. An electrical connector comprising a molded insulator having at least one cavity for a pin contact receptacle, said cavity having at least a forward facing annular shoulder, a section aft of said shoulder of a diameter greater than the outside diameter of said receptacle, and a smaller diameter section for pin contact fingers of said receptacle forward of said shoulder, a tubular pin contact receptacle inserted into said cavity with its pin receiving end first in the same direction that said shoulder faces, said receptacle having a longitudinal axis and diametrically opposing integral retention fingers cut out of the receptacle wall and extending in the direction of its pin receiving end at a small angle away from said axis, each of said retention fingers having its end bent outwardly and back to a position approximately parallel with said receptacle axis, thereby to form hooks the rearwardly facing ends of which engage said annular shoulder in said insulator cavity, each of said fingers being formed with an outwardly protruding bend so that an extraction tool may be inserted through the larger diameter portion of the cavity from the rear over the bends in the fingers to force the fingers into the tubular receptacle, and thus move the hooked ends thereof out of the way of the forward facing annular shoulder.

2. An electrical connector as defined in claim 1 wherein said forward facing shoulder is one edge of an annular groove, whereby said groove provides at the other edge thereof an aft facing shoulder, said shoulders being spaced to just accommodate said hooked ends of said fingers so that the axial position of said receptacle may be fixed.

3. An electrical connector as defined in claim 2 wherein said cavity is closed at the end thereof opposite the end through which said receptacle is inserted except for an orifice just large enough to receive a contact pin.

4. An electrical connector as defined in claim 3 wherein said pin contact receptacle is formed with contact fingers by having diametrically opposed longitudinal slots extending to the forward end from a point forward of said retention fingers, said contact fingers being flared at the ends thereof and bent so that the contact fingers are virtually tangent at their flared ends, whereby an inserted contact pin forces the contact fingers apart for a positive electrical contact therebetween.

5. An electrical connector as defined in claim 4 wherein said insulator is molded in two parts secured together, a first part having a bore with a counterbore opening at the rear of the first part to form the aft facing shoulder, and a second part which has an annular protrusion which extends partially into such counterbore to form said forward facing shoulder.

6. An electrical connector as defined in claim 5 wherein said pin contact receptacle is formed from a blank stamped from sheet metal with said retention fingers cut out and said slots between pin contact fingers cut out, and said retention finger hooks and bends are formed before said blank is roll formed into a tubular receptacle.

7. An electrical pin contact receptacle and an insulator having a cavity along an axis for receiving said receptacle from the rear thereof and an orifice for receiving a contact pin from the front, said insulator having a shoulder facing said orifice and said receptacle having integral retention fingers extending from the outer surface thereof forward in the direction of said orifice at a small angle away from said axis so that they protrude from the outer surface of said receptacle, each finger having the end thereof bent outwardly back to form a hook having a rearwardly facing end thereof to seat on said shoulder so that said receptacle is prevented from being backed out of said cavity without collapsing said fingers back into said receptacle, each finger having a bend extending outwardly so that a tool may be inserted along the surface of said receptacle over said bends in said retention fingers to collapse said fingers inwardly, thereby to release said hooks from said shoulder for extraction of said receptacle through the rear of said cavity, said cavity having a larger cross dimension in said cavity from the rear thereof to said shoulder than from said orifice back toward the position of said shoulder in order to provide space to receive said tool from the rear.

8. An electrical pin contact receptacle and an insulator as defined in claim 7 wherein said cavity has a second shoulder facing aft and spaced from said forward facing shoulder just enough to receive said hooked ends of said retention fingers.

9. An electrical pin contact receptacle as defined in claim 8 wherein said orifice for receiving said pin is of a dimension just sufficient for said pin, and less than the outer dimension of said receptacle at its forward end, thereby providing a closed entry insulator for said receptacle.

10. An electrical pin contact receptacle as defined in claim 9 wherein said receptacle is comprised of a stamped and tubular formed blank, and said retention fingers are formed by bending elongated interior sections of said blank extending in a forward direction along the length of said blank.

11. An electrical pin contact receptacle as defined in claim 10 wherein said blanks include elongated end sections extending from a point just forward of said retention fingers to the end thereof, and said sections are formed to have flared ends and to converge toward each other so that said sections are virtually tangent at the flared ends thereof.

12. A connector comprised of at least one pin contact receptacle and an insulator, said receptacle being inserted pin receiving end first into a cavity in said insulator, said cavity having an annular groove to provide a shoulder fore and aft, and said receptacle having diametrically opposed spring fingers for retention of said receptacle in said cavity, each of said fingers extending forwardly and outwardly and having its forward end bent outwardly and back to form a hook that nests in said groove, and having a bend in the middle extending outwardly, whereby a tubular tube can be inserted into said cavity from the rear and over said bends in said fingers to depress said fingers sufficiently for said hooks to be moved out of said annular ring, thereby releasing said receptacle from said cavity for extraction from the rear.

* * * * *